US009180657B2

(12) United States Patent
Bechberger

(10) Patent No.: US 9,180,657 B2
(45) Date of Patent: Nov. 10, 2015

(54) METHOD FOR STARTING CONTINUOUS PRINTING WITH REDUCED APPLICATION OF DAMPENING SOLUTION AND PRINTING PRESS FOR CARRYING OUT THE METHOD

(75) Inventor: Thomas Bechberger, Östringen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 888 days.

(21) Appl. No.: 12/180,856

(22) Filed: Jul. 28, 2008

(65) Prior Publication Data

US 2009/0025585 A1 Jan. 29, 2009

(30) Foreign Application Priority Data

Jul. 27, 2007 (DE) ..... 10 2007 035 664

(51) Int. Cl.
*B41M 1/06* (2006.01)
*B41F 33/00* (2006.01)
*B41F 7/26* (2006.01)

(52) U.S. Cl.
CPC ..... *B41F 33/0054* (2013.01); *B41F 7/26* (2013.01); *B41M 1/06* (2013.01)

(58) Field of Classification Search
CPC ..... B41F 7/24
See application file for complete search history.

(56) References Cited

U.S. PATENT DOCUMENTS 5,081,926 A 1/1992 Rodi
5,887,521 A 3/1999 Nakamura et al.
6,257,144 B1 7/2001 Erhardt et al.
6,257,714 B1 7/2001 Seccombe
2004/0250723 A1 12/2004 Buck
2007/0125246 A1* 6/2007 Dawley et al. ..... 101/147

FOREIGN PATENT DOCUMENTS

DE 2607808 A1 9/1977
DE 3034588 A1 3/1982
DE 3843473 A1 7/1990
DE 19921628 B4 12/1999
DE 10129555 A1 1/2002
JP 2007098734 A 4/2007
WO 9616806 6/1996

OTHER PUBLICATIONS

German Search Report.

* cited by examiner

*Primary Examiner* — Joshua D Zimmerman
(74) *Attorney, Agent, or Firm* — Laurence A. Greenberg; Werner H. Stemer; Ralph E. Locher

(57) ABSTRACT

A method for operating an offset printing press having at least one printing unit with an inking unit, a plate cylinder for receiving a printing plate, a blanket cylinder, an impression cylinder and a dampening unit, and for controlling an application of dampening solution from the dampening unit onto the plate cylinder, includes predampening the printing plate. After a printing pressure has been switched on between the blanket cylinder and the impression cylinder and after a printing material transport through the offset printing press has been switched on, a supply of dampening solution to the plate cylinder in the printing unit is reduced to a pronounced extent at least once for a short predefined time period, as a result of which an excess of dampening solution produced by the predampening does not accumulate permanently in the inking unit. A printing press for carrying out the method is also provided.

7 Claims, 3 Drawing Sheets

METHOD FOR STARTING CONTINUOUS PRINTING WITH REDUCED APPLICATION OF DAMPENING SOLUTION AND PRINTING PRESS FOR CARRYING OUT THE METHOD

CROSS-REFERENCE TO RELATED APPLICATION

This application claims the priority, under 35 U.S.C. §119, of German Patent Application DE 10 2007 035 664.3, filed Jul. 27, 2007; the prior application is herewith incorporated by reference in its entirety.

BACKGROUND OF THE INVENTION

Field of the Invention

The present invention relates to a method for operating an offset printing press including at least one printing unit having an inking unit, a plate cylinder for receiving a printing plate, a blanket cylinder, an impression cylinder and a dampening unit, and the present invention relates, in particular, to a method for controlling an application of dampening solution from the dampening unit onto the plate cylinder. The invention also relates to an offset printing press for carrying out the method.

Offset printing presses require a printing emulsion including dampening solution and ink for printing operation. During continuous printing operation, the emulsion is kept in a largely constant state, while the printing emulsion has to be set up initially before continuous printing. To that end, before continuous printing, first of all a generous quantity of dampening solution is usually applied to the printing plate of the plate cylinder in the printing units of the offset printing press, in order to carry out what is known as predampening. A method of that type for metering dampening solution before the start of printing is known from German Patent DE 199 21 628 B4, corresponding to U.S. Pat. No. 6,257,144 B1. The method which is described therein is intended to optimize, in particular, the startup of an offset printing press after a print interruption. In that case, the operation of predampening, which is necessary during restarting, is checked for its duration. The print interruption duration is stored, and the actual print interruption duration is compared with the stored time duration. If the actually determined interruption duration is longer than the predefined time duration, a defined method for controlling the dampening unit is used. To that end, the dampening rolls in the inking unit in the individual printing units are first of all operated at an increased rotational speed during a first number of revolutions of the plate cylinder in the printing unit and are subsequently operated at the rotational speed in continuous printing operation during a second number of revolutions of the plate cylinder. That happens before the printing material transport of sheets is switched on again. However, if the interruption duration is shorter than or equal to the predefined time duration, the dampening roll in the dampening unit is operated at an increased rotational speed during a number of plate cylinder revolutions which is less than the first number, and is subsequently operated at the rotational speed during continuous printing operation before the supply of sheets during the second number of plate cylinder revolutions. However, the supply of dampening solution, which is controlled in that way, relates exclusively to predampening before the printing material transport is switched on and therefore before sheet running is switched on.

However, it has been shown in the case of frequent startups of the printing press in close sequence, that the predampening can lead to problems. As a result of frequent starting operations with the necessary predampening, an accumulation of dampening solution can be set in the inking unit, which then leads to problems in the print quality. For example, a reduction in the color density or an increase in ghosting on the produced printing materials has been determined. Attempts have been made in the past to counteract that by shortening the predampening, in order to avoid the accumulation of dampening solution. However, the shortened predampening in turn leads to the first printed sheets during the startup of the printing press being overinked to a pronounced effect in sheet-fed offset printing presses. That smearing at the start, as it is known, increases the quantity of waste paper considerably. Moreover, it has been proven that, despite the greatly reduced time duration of the predampening, a plurality of starting operations in close sequence still lead to the known problems which are to be attributed to an accumulation of dampening solution in the inking unit. German Patent DE 199 21 628 B4, corresponding to U.S. Pat. No. 6,257,144 B1, has not disclosed a way in which that accumulation of the dampening solution in the inking unit can be reduced or even avoided.

SUMMARY OF THE INVENTION

It is accordingly an object of the present invention to provide a method for starting continuous printing with reduced application of dampening solution and a printing press for carrying out the method, which overcome the hereinaforementioned disadvantages of the heretofore-known methods and printing presses of this general type and which reduce or even avoid the accumulation of dampening solution in the inking unit, in particular in the case of frequent renewed startups and starting operations in an offset printing press.

With the foregoing and other objects in view there is provided, in accordance with the invention, in an offset printing press having at least one printing unit with an inking unit, a plate cylinder for receiving a printing plate, a blanket cylinder, an impression cylinder and a dampening unit, a method for operating the offset printing press and for controlling an application of dampening solution from the dampening unit onto the plate cylinder. The method comprises predampening the printing plate. After switching on printing pressure between the blanket cylinder and the impression cylinder and after switching on a printing material transport through the offset printing press, a supply of dampening solution to the plate cylinder in the printing unit is reduced to a pronounced extent at least once for a short predefined time period, for preventing excess dampening solution produced by the predampening from accumulating permanently in the inking unit.

With the objects of the invention in view, there is also provided an offset printing press, comprising at least one printing unit having an inking unit, a plate cylinder for receiving a printing plate, a blanket cylinder, an impression cylinder and a dampening unit. A control computer is configured to predampen the printing plate and to reduce a supply of dampening solution to the plate cylinder in the printing unit to a pronounced extent at least once for a short predefined time period, for preventing an excess of dampening solution produced by the predampening from accumulating permanently in the inking unit, after switching on printing pressure between the blanket cylinder and the impression cylinder and after switching on a printing material transport through the offset printing press.

The method according to the invention and the printing press according to the invention can be used both in sheet-fed offset printing presses and in web-fed offset printing presses which have dampening units in the printing units. In principle, the printing units of offset printing presses are of largely identical construction. Each printing unit has an inking unit and a dampening unit, and a plate cylinder for receiving a printing plate, a blanket cylinder which can be thrown onto the plate cylinder for transferring ink onto the printing material, and an impression cylinder which forms a press nip together with the blanket cylinder. The dampening solution from the dampening unit is mixed with the ink from the inking unit to form a printing emulsion on the plate cylinder. The control of the application of dampening solution to the plate cylinder is enormously important for achieving a satisfactory print quality. The present invention is then distinguished by the fact that, after the printing pressure has been switched on between the blanket cylinder and the impression cylinder and after the printing material transport in the offset printing press has been switched on, the supply of dampening solution to the plate cylinder in the printing unit is reduced to a pronounced extent for a predefined time period. The reduction in the supply of dampening solution at the beginning of continuous printing can therefore prevent the excess of dampening solution which is produced by the predampening from accumulating permanently in the inking unit. Nevertheless, the predampening phase does not have to be shortened, as in the prior art, in order to reduce the supply of dampening solution, which would likewise reduce the print quality. It is then possible by way of the present invention to ensure sufficient predampening and at the same time to reduce the accumulation of the excess dampening solution in the inking unit. To this end, it is sufficient, at the beginning of continuous printing operation, when the first sheets or the first web section run through the printing units of the offset printing press, to reduce the supply of dampening solution to the plate cylinder in the printing units to a pronounced extent at least once for a short time. In a printing press having a sheet format of 105 cm, it has proven advantageous that the operation of predampening takes place over four machine revolutions, while the operation with the reduced supply of dampening solution takes place during three machine revolutions when the inking unit and the dampening unit in the printing unit are in contact with one another. Those few revolutions correspond to a small time duration as a consequence of the usual machine speeds of up to 18,000 sheets per hour in continuous printing operation. If the inking unit and the dampening unit in the individual printing units are separated from one another, the number of revolutions for predampening is reduced to three, while the number of revolutions for the reduced supply of dampening solution is increased to five revolutions. After the short time duration of the reduced supply of dampening solution has ended, the supply of dampening solution is set again to the normal quantity for continuous printing operation. If necessary, the supply of dampening solution can also be reduced to a pronounced extent or interrupted for a short time repeatedly after the start of continuous printing.

In accordance with another mode or first refinement of the invention, the supply of dampening solution to the plate cylinder is interrupted for a short time. In this case, the supply of dampening solution to the plate cylinder is suppressed completely, as a result of which the excess of dampening solution can be dissipated particularly quickly. The interruption in the supply of dampening solution can be achieved by the fact that the dampening solution metering roll is thrown off the dampening solution applicator roll in the dampening unit for a defined number of sheets or revolutions of the plate cylinder. As a result, the application of dampening solution to the printing plate can be interrupted for a short time simply and quickly in terms of reaction.

In accordance with a further mode or alternative refinement of the invention, the dampening unit has a dampening solution dip roll and the rotational speed of the dampening solution dip roll is reduced to a pronounced extent for a predefined time duration. In this embodiment, the supply of dampening solution between the printing plate and the dampening unit is not interrupted completely, but rather the application of dampening solution is reduced to a pronounced extent by a reduced delivery capacity of the dampening solution dip roll. In this case, the dampening solution applicator rolls also remain thrown onto the printing plate, as a result of which the amount of dampening solution in the printing emulsion on the dampening solution applicator roll is also reduced. Since there are printing presses in which the dampening solution metering roll cannot be separated from the dampening solution applicator roll, only the possibility of throwing the dampening solution applicator rolls off the printing plate would remain in those machines. However, when the dampening solution applicator roll is thrown off, the application of dampening solution to the dampening solution applicator rolls cannot be dissipated, so that an excess of dampening solution on the printing plate would result again when the dampening solution applicator rolls are thrown on again. It is therefore appropriate in those printing presses only to reduce the supply of dampening solution by lowering the rotational speed of the dampening solution dip roll. However, the relatively slow time response of the rotational speed of the dampening solution dip roll makes it difficult to set a clearly defined reduction in the rotational speed of the dampening solution dip roll for a defined time duration for dampening solution reduction. To that extent, the dampening solution reduction by interrupting the supply of dampening solution through the use of dampening solution applicator rolls and dampening solution metering rolls which are thrown off one another, is the better procedure.

In accordance with an added mode or further refinement of the invention, the printing plate on the plate cylinder is predampened by the application of dampening solution before the printing pressure is applied and the printing material transport is switched on. This predampening prevents pronounced overinking of the first printing materials which are produced with the offset printing press. Those printing materials which are overinked to a pronounced extent would otherwise accumulate as what is known as starting waste paper, which can lead to increased costs, in particular in the case of low runs. However, sufficient predampening can be achieved by the present invention, in order to reduce the starting waste paper, and nevertheless to prevent or reduce the accumulation of dampening solution in the inking unit by the briefly reduced supply of dampening solution.

In accordance with an additional mode or refinement of the invention, the dampening unit is actuated through the use of a control computer. The control computer monitors and controls all of the actuating operations on the offset printing press and therefore makes the work of the operator easier. A plurality of programs for starting up and for controlling continuous printing in the printing press can be stored in the control computer. According to the present invention, all continuous printing programs of the printing press include a module which briefly reduces the supply of dampening solution to the printing plate after printing pressure has been applied and the printing material transport has been switched on. The starting program with the reduced supply of dampening solution is called up automatically during every startup of the printing press, during a change of print job or during printing interruption, as a result of which the accumulation of dampening solution in the inking unit can be avoided reliably. The printer therefore does not have to think himself or herself of interrupting the supply of dampening solution briefly during each starting operation of the printing press, which he or she also can scarcely do appropriately due to the short time duration of the reduction.

In accordance with a concomitant mode of the invention, a few items of printing material are printed at the end of continuous printing operation when the inking unit is thrown off and the dampening unit is thrown off. As a result, a few items of printing material are transported through the printing press while printing pressure is applied. These few items of printing material take up the residual ink and dampening solution and therefore clean the machine for the next start of printing. The next start of printing can then take place with a correspondingly lower amount of dampening solution during predampening, as a result of which the excess of dampening solution can also be reduced by this measure. This measure can be combined with the brief reduction in dampening solution at the start of continuous printing, which leads to a particularly effective reduction in the excess of dampening solution, or else it can also be used separately.

Other features which are considered as characteristic for the invention are set forth in the appended claims.

Although the invention is illustrated and described herein as embodied in a method for starting continuous printing with reduced application of dampening solution and a printing press for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
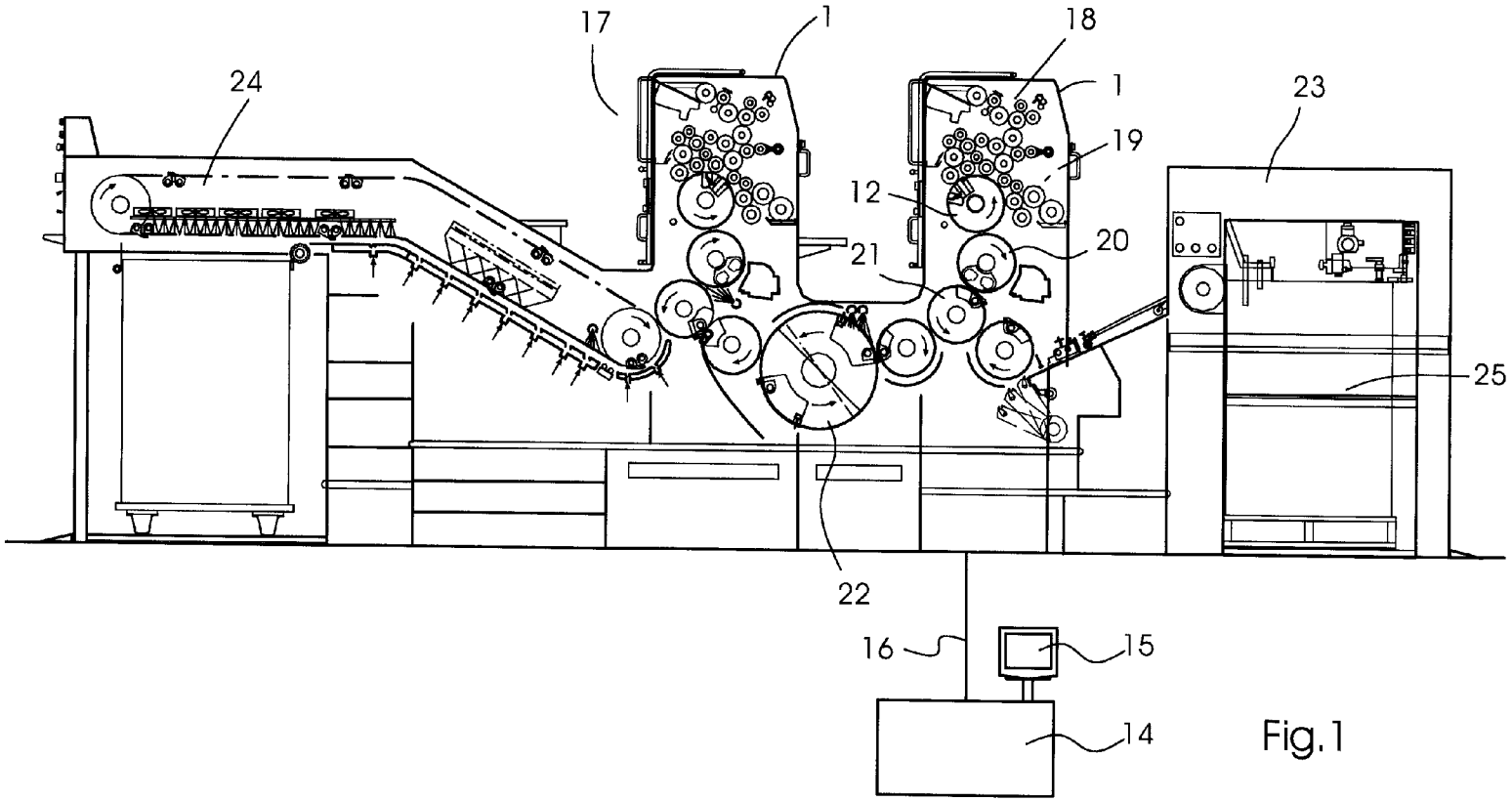
FIG. 1 is a diagrammatic, longitudinal-sectional view of a sheet-fed offset printing press having two printing units.

Referring now to the figures of the drawings in detail and first, particularly, to FIG. 1 thereof, there is seen a sheet-fed offset printing press 17 having two printing units 1. However, it goes without saying that the sheet-fed offset printing press 17 can also have more printing units 1 which usually have an identical construction. Each of the printing units 1 has an inking unit 18 and a dampening unit 19. Printing ink, which is required for the respective color separation, is metered through the use of the inking unit 18 for a current print job. Moreover, dampening solution can be added in a metered manner from the dampening unit 19 in order to set a printing emulsion including ink and dampening solution. The interior of the inking unit 18 and the dampening unit 19 is described in greater detail with regard to FIG. 2. In FIG. 1, ink and dampening solution are applied to a plate cylinder 12 which carries a printing plate 13 (see FIG. 2) with a printing image for the respective color separation. The plate cylinder 12 transfers the printing emulsion onto a blanket cylinder 20 which in turn forms a press nip with an impression cylinder 21. Sheet-shaped printing materials 25 can be printed with the individual color separations one over another in the press nip between the impression cylinder 21 and the blanket cylinder 20. The blanket cylinder 20 and the impression cylinder 21 are configured in such a way that they can be thrown off one another and the same is true of the plate cylinder 12 and the blanket cylinder 20. The transfer of dampening solution and ink between the individual cylinders 12, 20, 21 can therefore be suppressed by throwing the cylinders off one another. The printing sheets 25 are fed to the printing units 1 by a feeder 23. The printing sheets 25 are conveyed over transport cylinders 22 between the printing units 1 and are deposited in a delivery 24 following the last printing unit 1. The sheet-fed printing press 17 in FIG. 1 has a control computer 14 with a connected display screen 15 for operation by a printing staff. The control computer 14 serves to set and regulate actuating elements and drive motors. In particular, the control computer 14 also controls actuating drives in the individual printing units 1 for the inking unit 18 and the dampening unit 19. The control computer 14 is connected to the electric drives and actuating motors in the printing press 17 by a communications link 16.

Figure 2:
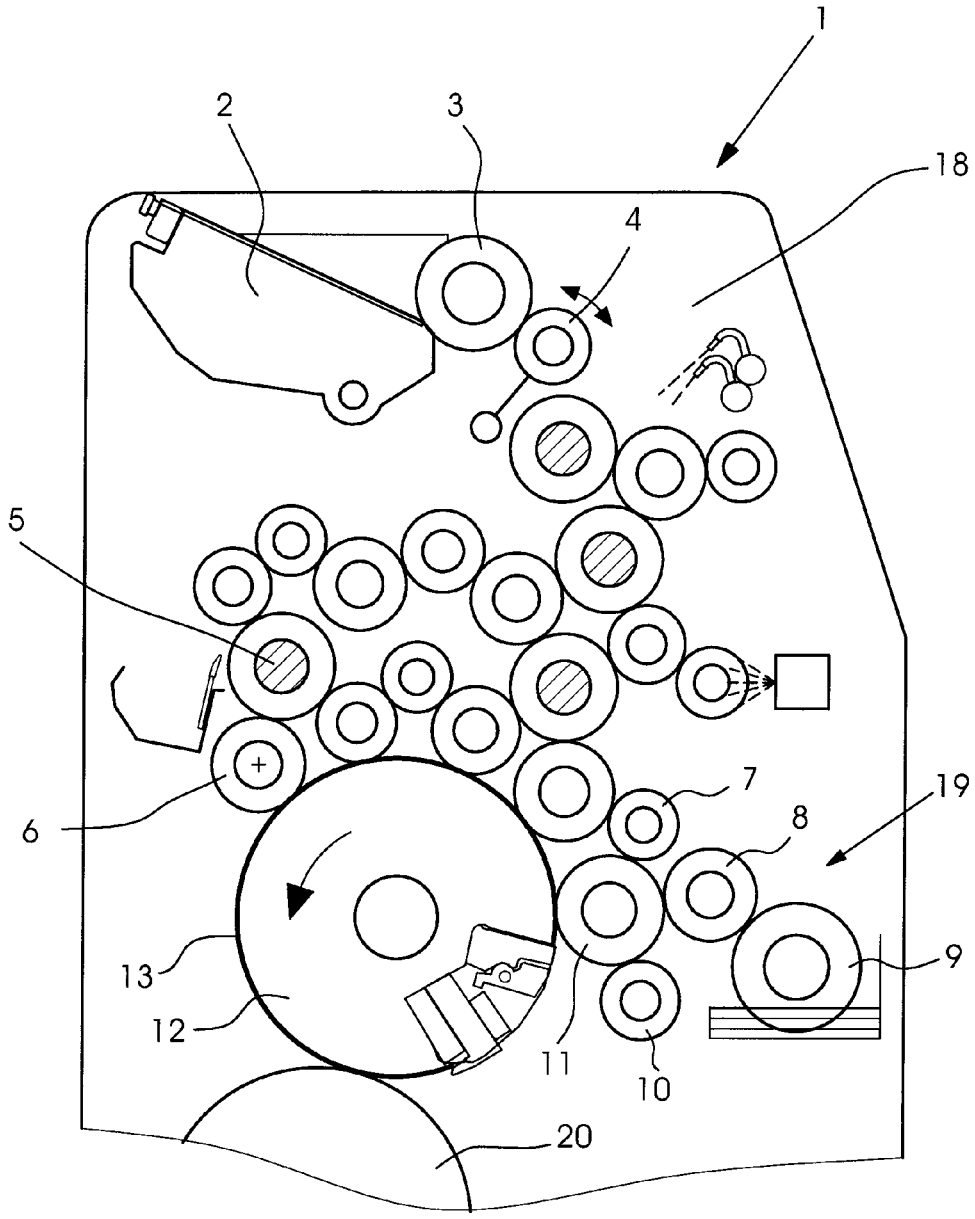
FIG. 2 is an enlarged, fragmentary, longitudinal-sectional view of a portion of a printing unit having a dampening unit, an inking unit and a plate cylinder.

More details regarding the construction of the dampening unit 19 and the inking unit 18 are illustrated in FIG. 2. It can be seen that the inking unit 18 includes an ink fountain 2, in which the printing ink for the respective printing unit 1 is stored. The ink is transferred from this ink fountain 2 to a ductor roll 4 through the use of a rotating ink fountain roll 3. The ductor roll 4 can be pivoted back and forth between an adjacent ink distributor roll 5 and the rotating ink fountain roll 3 according to the illustrated arrow. The more often the ductor roll 4 is pivoted back and forth and the longer it is in contact with the ink fountain roll 3 and the ink distributor roll 5, the more ink is transferred over the ductor roll 4 from the ink fountain 2 onto the ink distributor roll 5. There are further ink distributor rolls 5 in the inking unit 18, which are marked in a shaded manner and are moved back and forth in the axial direction by electric motors. The last ink distributor rolls 5 are in contact with ink applicator rolls 6 which transfer the printing ink onto the printing plate 13 of the plate cylinder 12 in the printing unit 1. The ink applicator rolls 6 can be thrown onto and off the printing plate cylinder 12, in order for it to thus be possible to interrupt the supply of ink between the inking unit 18 and the plate cylinder 12.

The dampening unit 19, which likewise has a plurality of rolls, is situated on the right-hand side in FIG. 2. In addition, the dampening unit 19 includes a dampening solution reservoir, from which dampening solution is conveyed through the use of a dampening solution dip roll 9. The dampening solution dip roll 9 is likewise driven by a motor having a rotational speed which is variable. The dampening solution dip roll 9 is connected to a dampening solution metering roll 8 which transfers the dampening solution onto a following dampening solution applicator roll 11. The dampening solution is in turn transferred from the dampening solution applicator roll 11 onto the printing plate 13 of the plate cylinder 12. In the printing unit 1 in FIG. 2, the dampening solution metering roll 8 can be thrown off the dampening solution applicator roll 11, in order to thus interrupt the supply of dampening solution between the dampening solution applicator roll 11 and the dampening solution metering roll 8. In order to distribute the dampening solution uniformly on the dampening solution applicator roll 11, a dampening solution distributor roll 10 is also situated next to the dampening solution applicator roll 11. The dampening solution distributor roll 10 is likewise moved back and forth in the axial direction through the use of a motor and thus equalizes the application of dampening solution. A bridging roll 7, which can be thrown off the inking unit 18, is situated between the dampening unit 19 and the inking unit 18. When the bridging roll 7 is thrown off, the dampening unit 19 and the inking unit 18 are no longer in direct contact with one another, as a result of which no dampening solution can pass directly from the dampening unit 19 into the inking unit 18. The transfer of dampening solution into the inking unit 18 is then only possible again indirectly over the plate cylinder 12.

Figure 3:
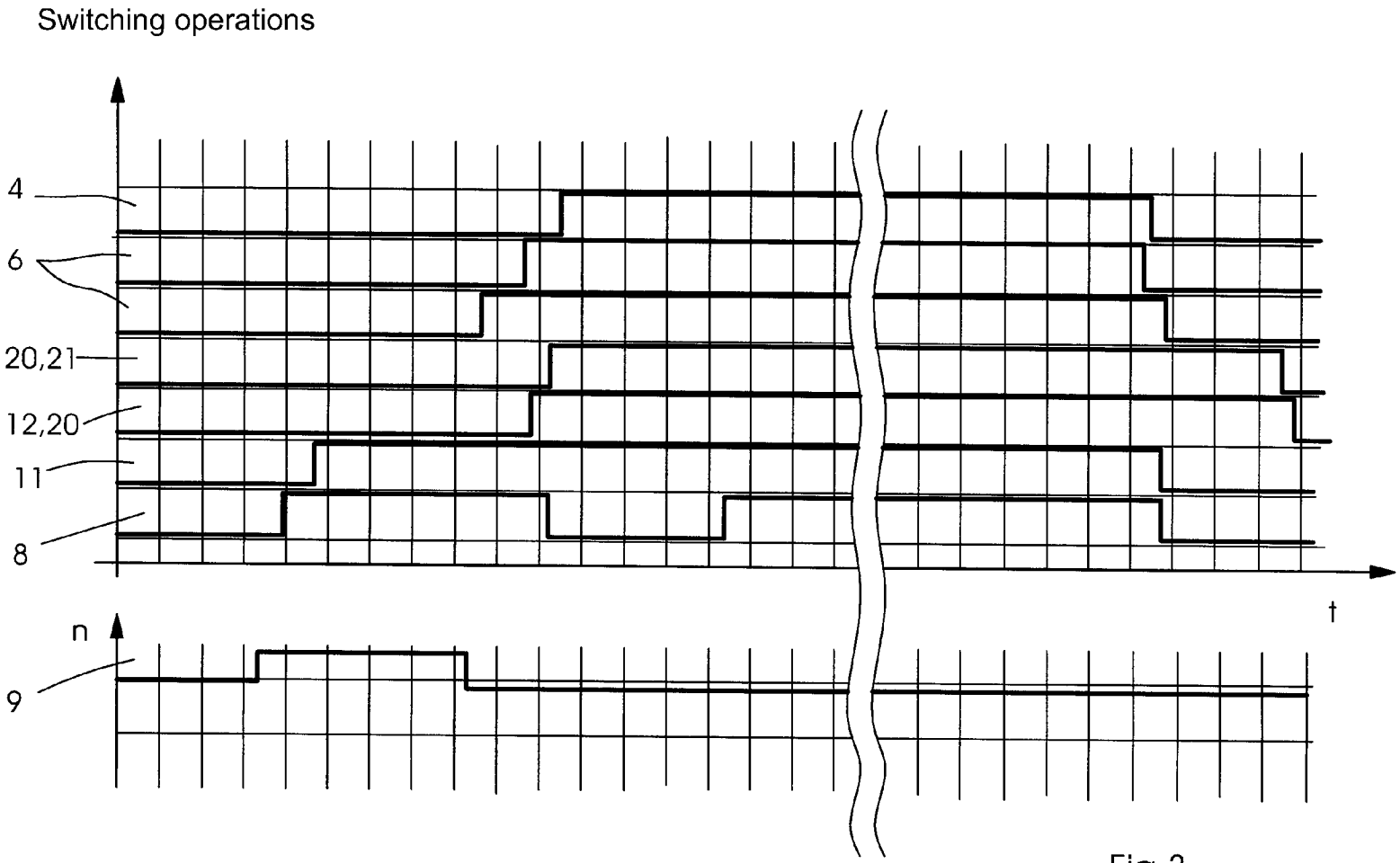
FIG. 3 is an operating diagram of a printing unit at the start of continuous printing and at the end of continuous printing.

The connection of the individual rolls and cylinders in the printing units 1 during startup of the offset printing press 17, during a new print job or after a print interruption, can be gathered from FIG. 3. First of all, the dampening solution metering roll 8, which then transfers dampening solution onto the dampening solution applicator rolls 11, is switched on when the dampening solution dip roll 9 is running. The dampening solution applicator rolls 11 are then thrown onto the plate cylinders 12, in order to thus make predampening possible over a plurality of revolutions. Before the end of the predampening phase, the ink applicator rolls 6 of the inking unit 18 are placed onto the plate cylinder 12, as a result of which ink is transferred onto the printing plate 13 for the first time. In this case, the ink applicator rolls 6 are placed on one after another. After the last ink applicator roll 6 has been switched on, first of all the plate cylinder 12 and the blanket cylinder 20 are thrown onto one another briefly one behind another and then the blanket cylinder 20 is thrown onto the impression cylinder 21. The sheet transport in the feeder 23 has previously been switched on, as a result of which the impression cylinder 21 and the blanket cylinder 20 come into contact only when the first printing materials 25 have arrived in the respective printing unit 1. Finally, shortly after the start of continuous printing, the ductor roll 4 in the inking unit 18 is set in motion, in order to transport ink from the ink fountain 2 into the inking unit 18. Moreover, according to the invention, the dampening solution metering roll 8 is thrown off the dampening solution applicator rolls 11 briefly at the beginning of continuous printing operation, as is shown in FIG. 3, in order to rapidly dissipate the excess of dampening solution on the printing plate 12 which was produced during the predampening phase. After this short interruption of the supply of dampening solution, the dampening solution metering roll 8 is thrown on again and the supply of dampening solution for continuous printing operation is started. Moreover, in the lowermost section in FIG. 3, a considerable increase in the rotational speed of the dampening solution dip roll 9 during predampening can be seen. However, as soon as the process of predampening is concluded, the dampening solution dip roll 9 is operated at a constant rotational speed which is adapted to the respective continuous printing speed. The excess of dampening solution at the start of continuous printing is thus counteracted effectively by the brief throwing off of the dampening solution metering roll 8 and the associated interruption of the supply of dampening solution.

Moreover, the right-hand side in FIG. 3 shows an improved switching off operation at the end of printing. First of all, one of the ink applicator rolls 6 is thrown off the plate cylinder 12, and shortly afterward the ductor roll 4 in the inking unit 18 is switched off. Subsequently, the other ink applicator rolls 6 and the dampening solution applicator rolls 11 as well as the dampening solution metering roll 8 are also thrown off within one revolution of the plate cylinder 12. In this case, the sequence is unimportant, but it is important that the ink applicator rolls 6, the dampening solution metering roll 8 and the dampening solution applicator rolls 11 are thrown off within one revolution. After a predefined time duration, the plate cylinders 12 and the blanket cylinders 20 are then thrown off one another and the blanket cylinders 20 and the impression cylinders 21 are then thrown off one another in the printing units 1 while sheet running is switched on. At the same time, the sheet running is switched off. During the predefined time duration, the residual remaining ink and the residual remaining dampening solution in the printing unit 1 can thus be printed in the printing units while sheet running is switched on, as a result of which the printing plate 13 and the blanket cylinder 20 are cleaned for the next start of printing. Less dampening solution is then required for the next start of printing, which makes a reduced supply of dampening solution possible during predampening and thus reduces the excess of dampening solution after predampening. A further possibility is therefore afforded of reducing the excess of dampening solution and avoiding overinking of the printing plate. This measure makes an excellent combination with the brief reduction of dampening solution at the beginning of continuous printing, which leads to a particularly effective reduction in the excess of dampening solution and shortens the duration of the setting up phase before the start of continuous printing, since predampening then does not have to be carried out for so long.

The invention claimed is:

1. In an offset printing press having at least one printing unit with an inking unit, a plate cylinder for receiving a printing plate, a blanket cylinder, an impression cylinder and a dampening unit, a method for operating the offset printing press and for controlling an application of dampening solution from the dampening unit onto the plate cylinder, the method comprising the following steps:

predampening the printing plate; and after switching on printing pressure between the blanket cylinder and the impression cylinder and after switching on a printing material transport through the offset printing press, and while at the beginning of continuous printing, interrupting a supply of dampening solution to the plate cylinder in the printing unit at least once for a time period, without interrupting printing, for preventing excess dampening solution produced by the predampening from accumulating permanently in the inking unit, and setting the supply of dampening solution to a normal quantity again for continuous printing operation.

2. The method according to claim 1, which further comprises providing the dampening unit with a dampening solution dip roll, and reducing a rotational speed of the dampening solution dip roll.

3. The method according to claim 1, which further comprises providing the dampening unit with a dampening solution metering roll and a dampening solution applicator roll, and separating the dampening solution metering roll from the dampening solution applicator roll.

4. The method according to claim 1, which further comprises setting an excess of dampening solution on the printing plate by the predampening of the printing plate.

5. The method according to claim 1, which further comprises actuating the dampening unit with a control computer.

6. The method according to claim 1, which further comprises printing a few items of printing material at an end of a continuous printing operation when the inking unit is thrown off and the dampening unit is thrown off.

7. An offset printing press, comprising:

at least one printing unit having an inking unit, a plate cylinder for receiving a printing plate, a blanket cylinder, an impression cylinder and a dampening unit; and a control computer;

said control computer configured to predampen the printing plate; and said control computer configured to interrupt a supply of dampening solution to said plate cylinder in said printing unit at least once for a time period, without interrupting printing, for preventing an excess of dampening solution produced by the predampening from accumulating permanently in said inking unit after switching on printing pressure between said blanket cylinder and said impression cylinder while at the beginning of continuous printing and after switching on a printing material transport through the offset printing press, and setting the supply of dampening solution to a normal quantity again for continuous printing operation.

* * * * *